US007997343B2

(12) United States Patent
Erkol et al.

(10) Patent No.: US 7,997,343 B2
(45) Date of Patent: Aug. 16, 2011

(54) DYNAMIC SCALE REMOVAL TOOL AND METHOD OF REMOVING SCALE USING THE TOOL

(75) Inventors: Zafer Erkol, Sugar Land, TX (US); Gokturk Tunc, Stafford, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 37 days.

(21) Appl. No.: 12/125,120

(22) Filed: May 22, 2008

(65) Prior Publication Data

US 2009/0288834 A1 Nov. 26, 2009

(51) Int. Cl.
*E21B 43/00* (2006.01)
*E21B 37/00* (2006.01)
*E21B 7/18* (2006.01)

(52) U.S. Cl. ..... 166/312; 166/222; 175/67; 175/267

(58) Field of Classification Search ..... 166/311, 166/312, 222; 175/67, 267, 263
See application file for complete search history.

(56) References Cited

U.S. PATENT DOCUMENTS

| | | | | | |
|---|---|---|---|---|---|
| 671,429 | A | * | 4/1901 | Bacon | 175/17 |
| 1,511,898 | A | * | 10/1924 | Makay | 408/159 |
| 2,018,284 | A | * | 10/1935 | Schweitzer et al. | 175/54 |
| 2,136,350 | A | * | 11/1938 | Berkman | 82/1.2 |
| 3,311,179 | A | * | 3/1967 | Meredith | 175/263 |
| 3,447,272 | A | * | 6/1969 | Eppler | 451/38 |
| 3,749,187 | A | * | 7/1973 | Leathers | 175/269 |
| 3,750,771 | A | * | 8/1973 | Cugini | 175/269 |
| 3,850,241 | A | * | 11/1974 | Hutchinson | 166/222 |
| 3,892,274 | A | * | 7/1975 | Dill | 166/222 |
| 4,047,569 | A | * | 9/1977 | Tagirov et al. | 166/308.1 |
| 4,485,874 | A | | 12/1984 | Meyers | |
| 4,495,996 | A | | 1/1985 | Meyers et al. | |
| 4,518,041 | A | * | 5/1985 | Zublin | 166/312 |
| 4,671,360 | A | | 6/1987 | Jennings et al. | |
| 4,708,207 | A | | 11/1987 | Kalfayan et al. | |
| 4,964,464 | A | | 10/1990 | Myers | |
| 4,992,182 | A | | 2/1991 | Kalfayan et al. | |
| 5,051,197 | A | | 9/1991 | Kalfayan et al. | |
| 5,086,852 | A | * | 2/1992 | van Buskirk | 175/269 |
| 5,146,988 | A | | 9/1992 | Paul | |
| 5,183,112 | A | | 2/1993 | Paul et al. | |
| 5,282,509 | A | * | 2/1994 | Schurr, III | 166/311 |
| 5,722,489 | A | * | 3/1998 | Lambe et al. | 166/269 |
| 6,155,343 | A | * | 12/2000 | Nazzal et al. | 166/55 |
| 6,170,577 | B1 | | 1/2001 | Noles, Jr. et al. | |
| 6,173,771 | B1 | * | 1/2001 | Eslinger et al. | 166/173 |
| 6,924,253 | B2 | | 8/2005 | Palmer et al. | |
| 6,962,216 | B2 | * | 11/2005 | Zupanick | 175/263 |

(Continued)

FOREIGN PATENT DOCUMENTS

EP 1489260 A1 12/2004

(Continued)

*Primary Examiner* — Jennifer H Gay
(74) *Attorney, Agent, or Firm* — Michael L. Flynn; David R. Hofman; Robin Nava

(57) ABSTRACT

A scale removal tool with adjustably positionable fluid dispensing arms. The scale removal tool may be configured for delivery to within a hydrocarbon well via coiled tubing. Thus, fluid may be driven through the coiled tubing and through the tool at the fluid dispensing arms. The fluid may thereby be jetted at high pressure toward scale at the wall of the well in order to achieve its removal. In the case of a well having scale of varying thicknesses, the fluid dispensing arms may be dynamically positioned and repositioned while downhole in the well, depending on scale thickness.

10 Claims, 6 Drawing Sheets

U.S. PATENT DOCUMENTS 7,114,583 B2 * 10/2006 Chrisman ..... 175/67
7,117,959 B2 * 10/2006 Lah ..... 175/67
7,213,650 B2 5/2007 Lehman et al.
7,293,616 B2 * 11/2007 Tulloch ..... 175/269
7,296,627 B2 11/2007 Dyer
7,493,948 B2 * 2/2009 Cooper et al. ..... 166/241.3
7,584,811 B2 * 9/2009 Fanuel et al. ..... 175/285
2003/0183424 A1 * 10/2003 Tulloch ..... 175/263
2004/0112587 A1 * 6/2004 Van Drentham Susman et al. ..... 166/173
2006/0144620 A1 * 7/2006 Cooper et al. ..... 175/57

FOREIGN PATENT DOCUMENTS

WO W02006074017 A2 7/2006

* cited by examiner

DYNAMIC SCALE REMOVAL TOOL AND METHOD OF REMOVING SCALE USING THE TOOL

FIELD OF THE INVENTION

Embodiments described relate to coiled tubing for use in hydrocarbon wells. In particular, embodiments of coiled tubing are described utilizing a scale removal tool positioned at or near a downhole end thereof. In particular, embodiments of high pressure fluid dispensing "water jet" tools are described. These tools may employ downhole positionable fluid dispensing arms with respect to a wall of a well where scale buildup may be present.

BACKGROUND OF THE RELATED ART

Exploring, drilling and completing hydrocarbon wells are generally complicated, time consuming and ultimately very expensive endeavors. As a result, over the years increased attention has been paid to monitoring and maintaining the health of such wells. Significant premiums are placed on maximizing the total hydrocarbon recovery, recovery rate, and extending the overall life of the well as much as possible. Thus, logging applications for monitoring of well conditions play a significant role in the life of the well. Similarly, significant importance is placed on well intervention applications, such as clean-out techniques which may be utilized to remove debris from the well so as to ensure unobstructed hydrocarbon recovery.

Clean out techniques as indicated above may be employed for the removal of loose debris from within the well. However, in many cases, debris may be present within the well that is of a more challenging nature. For example, debris often accumulates within a well in the form of 'scale'. As opposed to loose debris, scale is the build-up or caking of deposits at the surface of the well wall. For example, the well wall may be a smooth steel casing within the well that is configured for the rapid uphole transfer of hydrocarbons and other fluids from a formation. However, a build-up of irregular occlusive scale may occur at the inner surface of the casing restricting flow there through. Indeed, scale may even form over perforations in the casing, thereby also hampering hydrocarbon flow into the well from the surrounding formation.

Unfortunately, scale build-up within a well may take place in a fairly rapid manner. For example, it would not be uncommon for hydrocarbon production to decrease on the order of several thousand barrels per day once a significant amount of scale begins to accumulate at the well wall. Furthermore, while a variety of conventional techniques are available for addressing scale, hundreds of millions of dollars are nevertheless lost every year to the curing of scale problems. That is, as described below, current scale removal techniques remain fairly inefficient, leaving significant production time lost to the application of the techniques.

Scale build-up generally results from the presence of water within the well. This may be the result of water production by the well or the intentional introduction of water to the well, for example, by a water injector to enhance hydrocarbon recovery. Regardless, the presence of water may ultimately lead to mineral deposits such as calcium carbonate, barium sulfate, and others which may be prone to crystallize and build-up in the form of scale at the inner wall of the well as noted above. Due to the nature of the scale, chemical techniques such as the introduction of hydrochloric or other acids are often employed to break up the scale. Unfortunately, however, the introduction of acids is generally followed by a soak period which increases the amount of production time lost. Furthermore, acids may not be particularly effective at breaking up harder scale deposits and may even leave the well wall primed for future scale build-up. Therefore, mechanical techniques as described below are often employed for scale removal.

Scale may be removed by a variety of mechanical techniques such as the use of explosives, impact bits, and milling. However, these techniques include the drawback of potentially damaging the well itself. Furthermore, the use of impact bits and milling generally fails to remove scale in its entirety. Rather, a small layer of scale is generally left behind which may act as a seed layer in encouraging new scale growth. As a result of these drawbacks, fluid mechanical jetting tools as described below may be most often employed for scale removal.

Water jetting tools are often deployed within a well to remove scale build-up as described above. A water jet tool may be dropped into the well via coiled tubing and include a rotating head for jetting water toward the well wall in order to fracture and dislodge the scale. The rotating head may include water dispensing arms that project outward from a central axis of the tool and toward the well wall. Additionally, in many cases, the water may include an abrasive in order to aid in the cutting into and fracturing of the scale as indicated.

For effective removal of scale with a water jetting tool as noted above, the water dispensing arms are securely prepositioned with an outer diameter that is as close as possible to the scale. In this manner, the full force of the water may be substantially taken advantage of. Unfortunately, however, the thickness of the scale within the well may be quite variable. For example, there may be regions of the well with minimal scale buildup, whereas a maximum scale thickness of over an inch may be present in other regions of the well. In such a scenario, the arms of the water jet tool may be securely positioned at an outer diameter that is within about half of an inch of the maximum scale thickness. Thus, a water jet application of the tool through the well may remove a substantial amount of scale in well regions of maximum scale thickness. However, in other well regions of lesser scale thickness, scale buildup may remain largely unaffected.

The variability in scale thickness may largely determine the effectiveness of a given run through of the tool in the well. For example, the arms of the tool may be set with a drift ring retainer of a given outer diameter and the tool run through the well as part of the scale removal application. However, only a portion of the scale may be removed down to a certain level in regions of maximum scale thickness. Thus, the tool may then be removed from the well and the arms securely repositioned at a larger outer diameter with a larger drift ring retainer by an operator at the oilfield.

A subsequent run of the tool through the well may then take place. This process may continue several times until the scale is fully removed. Indeed, today there are about 30 different standard drift ring sizes that are commercially available so as to allow for a significant number of runs of the tool through the well with differently sized or positioned tool arms. Unfortunately, each of these separate runs through the well may take between about 5 and 12 hours or more, depending on the depth of the well. Thus, with the trend toward wells of greater depths, the time lost in order to resize the tool arms for continuing the scale removal is increasing. As such, the expense of the overall hydrocarbon recovery effort is substantially increasing as well.

SUMMARY

A scale removal tool for use with coiled tubing is provided. The scale removal tool may be disposed at the end of coiled tubing and include a fluid dispensing arm for directing a fluid at a wall of a well for removal of scale thereat. The fluid dispensing arm may be of a configuration for adjustable positioning thereof relative to the wall of the well. In one embodiment, this adjustable positioning may be achieved by the use of a drift ring of adjustable diameter adjacent the fluid dispensing arm.

DETAILED DESCRIPTION

Embodiments are described with reference to certain coiled tubing operations employing a scale removal tool. The scale removal tool is configured for positioning downhole in a well for removing scale buildup from a wall of the well. In particular, the scale removal tool described is of a two armed configuration for water jet or 'blasting' scale from the well wall. However, a variety of alternative scale removal tool configurations may be employed. For example, the tool may have a different number of arms than two or be configured for delivery of fluids other than water alone, such as acids. Furthermore, the fluid may be a mixture of a variety of liquids including water, acid, and others, and may also include non-fluid particles mixed therein. For example, abrasive particles may be mixed in with the utilized fluid. Regardless, embodiments described herein include at least one fluid dispensing arm that is adjustably positionable relative to the well wall while located downhole in the well.

Figure 1:
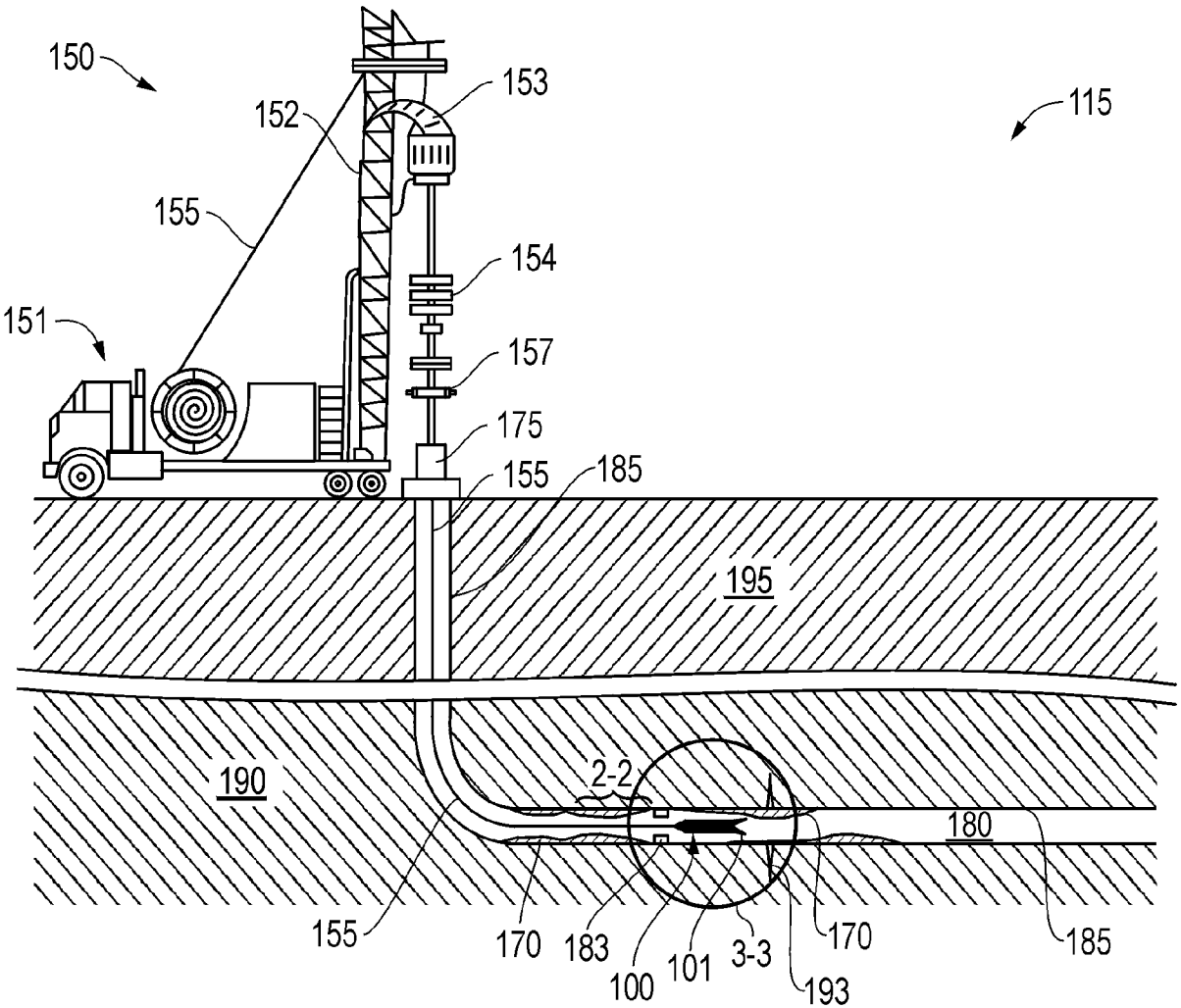
FIG. 1 is an overview of a coiled tubing assembly employing an embodiment of a scale removal tool in a well with a downhole adjustably positionable fluid dispensing arm.

Referring now to FIG. 1, a coiled tubing assembly is depicted at an oilfield 115. The assembly includes coiled tubing 155 for positioning downhole in a well 180. In the depiction of FIG. 1, the wall 185 of the well 180 is defined by a borehole casing which may be of steel or other conventional construction. Deposits of scale 170 are depicted on the wall 185 in certain regions of the well 180 which may reduce its productivity by restricting flow therethrough. Indeed, the scale 170 may even block well access to perforations 193 into the formation 190, thereby further hydrocarbon limiting recovery.

In order to address the problems associated with scale 170 as noted above, a scale removal tool 100 is disposed at the end of the coiled tubing 155. The tool 100 includes fluid dispensing arms 101 disposed at the end thereof. The arms 101 may be employed for directing a fluid 350 radially toward the wall 185 for removal of any scale 170 thereat (see FIG. 3). As detailed further below, the position of these arms 101 may be adjusted relative to the well wall 185 to maximize scale removal. This repositioning may take place while the tool 100 remains downhole. As such, scale removal may be maximized without requiring removal of the tool 100 from the well 180 in order to reposition the arms 101. Thus, the efficiency of the scale removal application may be substantially enhanced.

Continuing with reference to FIG. 1, surface equipment 150 is shown at the oilfield 115 for delivery and management of the coiled tubing operation. The surface equipment 150 includes a conventional coiled tubing truck 151 for mobile transport and delivery of the coiled tubing 155 to the site of the well 180 at the oilfield 115. The coiled tubing 155 may be spooled out from the coiled tubing truck 151 and through an injector assembly 153 supported by a tower 152 at the truck 151. The injector assembly 153 may be employed to drive the coiled tubing 155 through a blowout preventor stack 154, master control valve 157, well head 175, and/or other surface equipment 150 and into the well 180.

The well 180 of FIG. 1 is of a horizontal or deviated configuration lending itself to intervention by way of a coiled tubing operation as shown. That is, the injector assembly 153 is configured to drive the coiled tubing 155 with force sufficient to overcome the deviated nature of the well 180. For example, as depicted in FIG. 1, the coiled tubing 155 is forced through various formation layers 195, 190 and around a bend in the well 180 to the horizontal position shown. The driving forces supplied by the injector assembly 153 are sufficient to overcome any resistance imparted on the coiled tubing 155 by the well wall 185 as the assembly traverses the bend in the well 180. In the embodiment shown, the coiled tubing 155 and scale removal tool 100 may also traverse features such as a restriction 183 and scale 170 as detailed further below. However, the driving forces supplied by the injector assembly 153 may again be sufficient to overcome any resistance imparted by the depicted features 183, 170.

Figure 2:
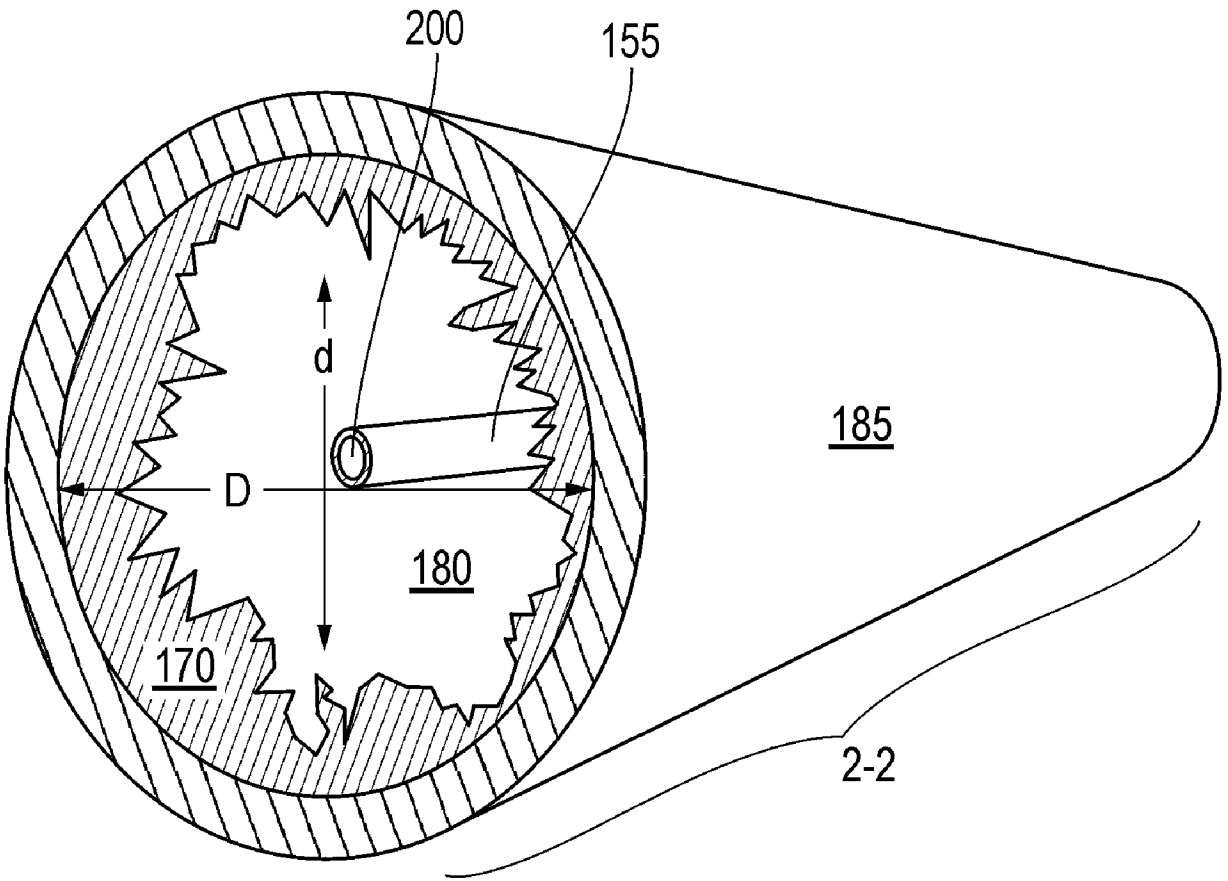
FIG. 2 is a perspective view of a portion of the well taken from 2-2 of FIG. 1 with coiled tubing therein.

Referring now to FIG. 2, a cross-sectional perspective view of a portion of the well 180 is depicted taken from 2-2 of FIG. 1. From this angle, the buildup of scale 170 is apparent at the interior wall of the casing (e.g. the well wall 185). As such, the un-occluded fluid pathway through the well 180 is limited to an effective diameter d of the well 180 that reduces the flow and recovery rate from the well 180. For example, in an embodiment where the well 180 is configured to be of a 7 inch wall diameter D, the buildup of scale 170 may substantially reduce the effective diameter d down to about 4 inches at the location depicted in FIG. 2. Of course, as the thickness of the scale 170 varies throughout the well 180, the effective diameter d may similarly vary. Nevertheless, as particularly detailed with respect to FIGS. 5A-5C, the scale removal tool 100 of FIG. 1 may remain downhole as multiple arms 101 thereof are dynamically positioned and repositioned in order to effectively address the varying thicknesses of the scale 180. Additionally, as visible in FIG. 2, the coiled tubing 155 includes a pressurized fluid delivery channel 200 coupled to the scale removal tool 100 of FIG. 1 in order to address the noted buildup of scale 170.

Figure 3:
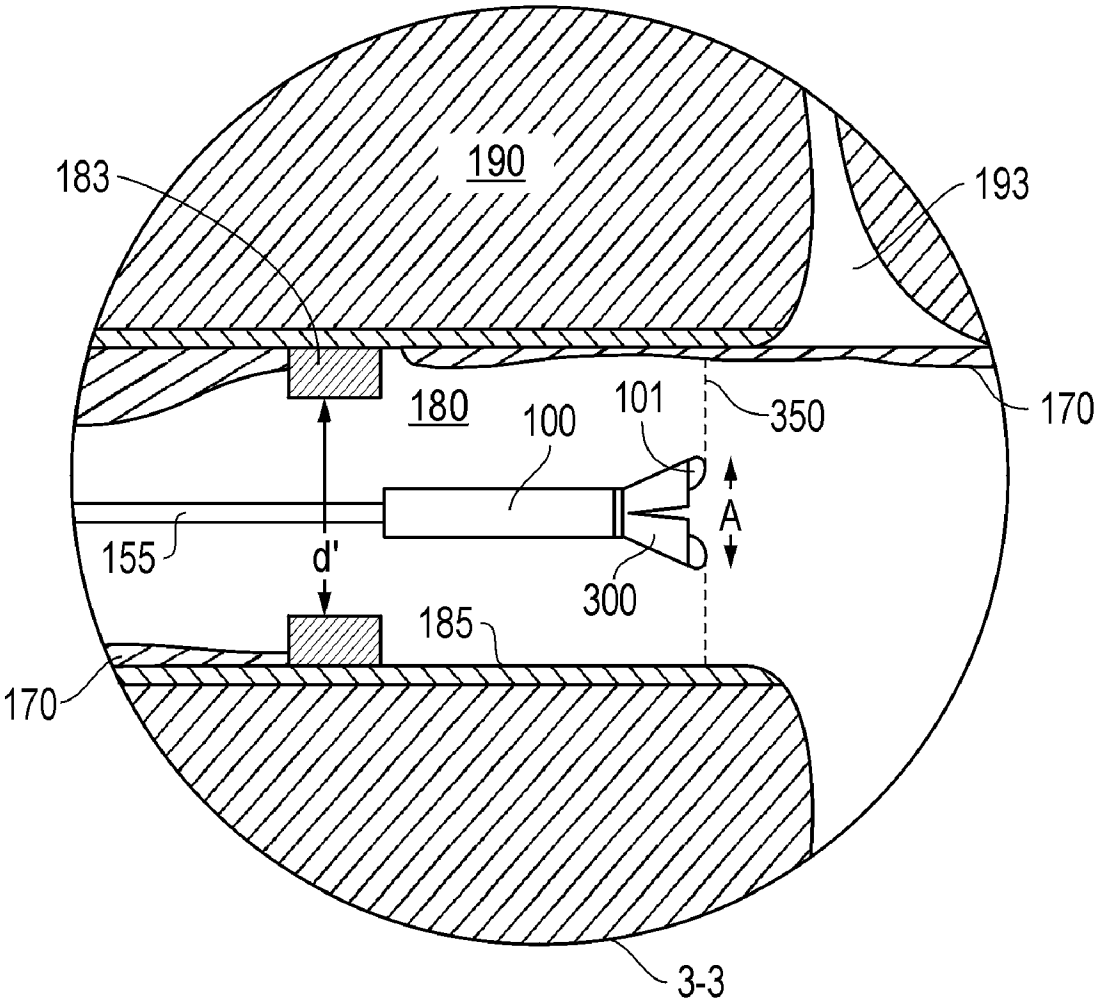
FIG. 3 is a side view of the scale removal tool taken from 3-3 of FIG. 1.

Referring now to FIG. 3, an enlarged view of the coiled tubing 155 and scale removal tool 100 is depicted, taken from 3-3 of FIG. 1. In FIG. 3, the effective diameter d' of the well 180 is limited at the site of the restriction 183 as shown. This restriction 183 may be a conventional nipple feature serving well functions unrelated to the described scale removal application. For example, the nipple restriction 183 may be employed to effectuate a centralizer, or serve production tubing, crossovers, valves, or mandrels in other applications.

Continuing with reference to FIG. 3, the arms 101 of the tool 100 are shown open to a given arm diameter A and dispensing a jet of fluid 350 toward the wall 185 of the well 180 for removal of scale 170 thereat. For example, this technique may be employed to unclog the blocked perforation 193 shown in FIG. 3. Removal of scale 170 in this manner may be achieved by dispensing the fluid 350 at between about 1,000 PSI and about 2,000 PSI.

As detailed further below, the arms 101 may be dynamically guided by a drift ring 300 of adjustable diameter to achieve the arm diameter A depicted. In this manner, the arms 101 may be positioned relative to the wall 185 and the noted scale 170 for optimum scale removal without the need to remove the tool 100 from the well 180 to manually reposition the arms 101. As such, the arms 101 may display an initial arm diameter A suited for passage beyond the depicted restriction 183 and later repositioned to another larger arm diameter A better suited for scale removal near the perforation 193 as shown.

As indicated, the arms 101 may be guided by the drift ring 300 which is itself of adjustable diameter. It is of note that, while of adjustable diameter, the drift ring 300 is configured in a manner biased against the arms 101. That is, the drift ring 300 is configured with a closing tendency relative to the arms 101. This provides a degree of stability to the downhole end of the scale removal tool 100. However, this also means that in order to change diameter of the arms 101 are the scale removal tool 100 is configured to overcome this closing tendency of the drift ring 300 as described below.

Figure 4:
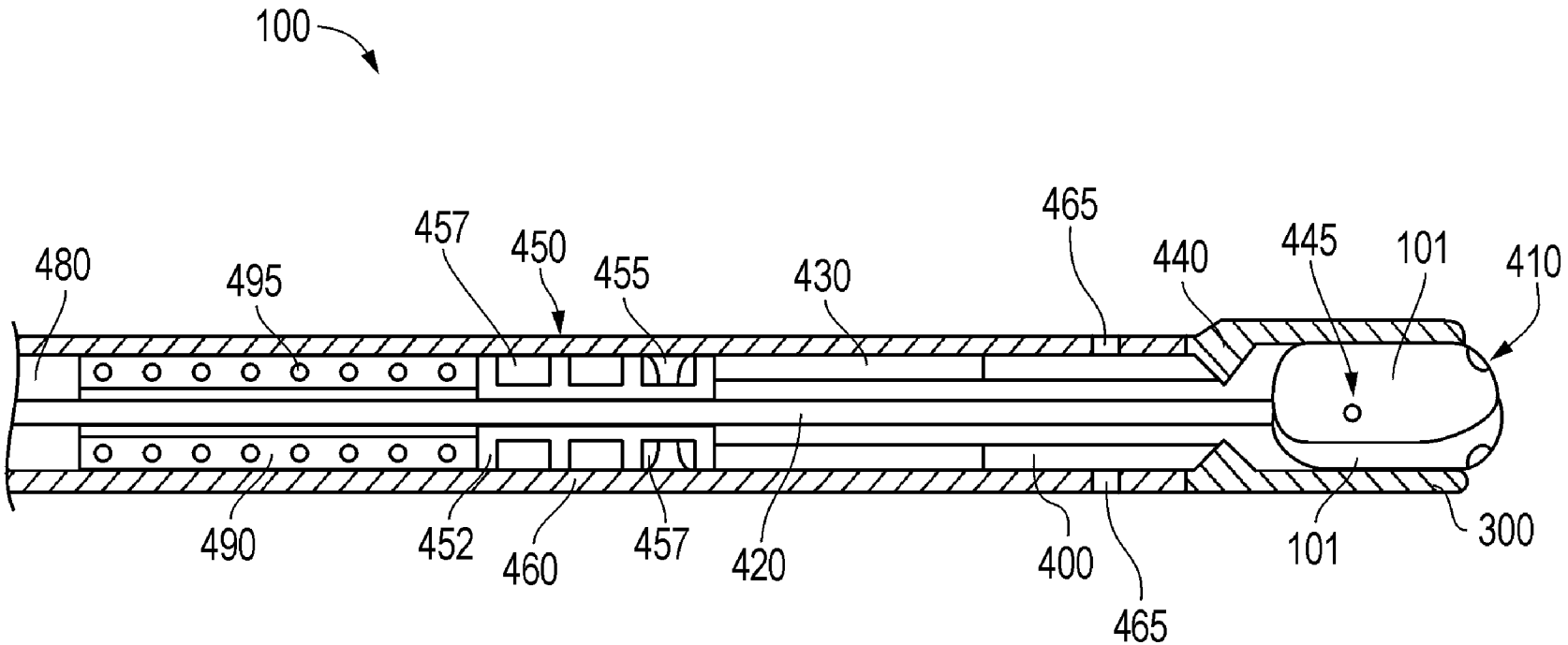
FIG. 4 is a side cross-sectional view of the scale removal tool of FIG. 1.

Referring now to FIG. 4, with added reference to FIG. 3, a cross-sectional view of the scale removal tool 100 is depicted revealing a manner by which the drift ring 300 may be actuated in order to overcome the noted closing tendency of the ring 300 and achieve the noted dynamic downhole changing positions of the arms 101 with respect to their diameter A. As shown, each arm 101 includes an exit orifice 410 for directing a fluid 350 under pressure at a wall 385 of the well 180. The orifice 410 may be of a variety of diameter sizes. For example, 0.094 inch, 0.125 inch, 0.134 inch, and other diameters may be utilized. As for the fluid 350, it may be directed through a central passage 420 in line with the delivery channel 200 of the coiled tubing 155 (see FIG. 2). In one embodiment, the fluid is water. However, in other embodiments, acids such as hydrochloric acid or other fluids may be employed. Additionally, an abrasive such as silica beads may be provided in conjunction with the fluid 350 in order to promote scale removal.

Continuing with reference to FIG. 4, each arm 101 is retained in position as shown by a drift ring 300 of adjustable diameter. Thus, as the drift ring 300 is opened or closed, the diameter A of the arms 101 may be increased or decreased accordingly. With reference to FIG. 1, opening or closing of the drift ring 300 as indicated may be hydraulically actuated via surface equipment 150 through the coiled tubing 155. For example, a hydraulic chamber 480 of the scale removal tool 100 may be coupled to hydraulic means of the coiled tubing 155. As such, hydraulic pressure may be employed to control the position of an actuator housing 490 adjacent the chamber 480. In the embodiment shown, a biasing mechanism 495 in the form of a spring is provided within the housing 490. Regardless, the actuator housing 490 is configured to act upon a j-slot mechanism 450 or other positioning means to control the position of the drift ring 300 as described further below.

In the embodiment depicted in FIG. 4, the j-slot mechanism 450 is a rotable assembly that allows for responsive rotation of a j-slot housing 452 about pins 455 secured to an outer housing 460 of the scale removal tool 100. So, for example, as the actuator housing 490 is hydraulically advanced as noted above, the j-slot housing 452 may be rotated about the pins 455 advancing the housing 452 in a downhole direction toward the arms 101. Thus, the pins 455 would change positions from one chamber 457 of the housing 452 to another. In the described circumstance, the j-slot housing 452 would act upon an implement 430 to drive a drift ring actuator 400 toward the drift ring 300 and arms 101. In this manner, the actuator 400 would encounter an abutment 440 of the drift ring 300 in order to allow it to open to a larger diameter. As such, the arms 101 may then similarly open about a hinge 445 to a larger diameter.

Once opened to a given diameter, the arms 101 may be employed for an application as detailed below with reference to FIGS. 5A-5C. However, in the event that the arms 101 should ever become stuck at an undesirable diameter, for example one that is too large to allow tool movement to a new downhole location, the scale removal tool 100 is equipped with shear pins 465. The shear pins 465 may be configured with a predetermined breaking point such that once a given amount of force is applied through pushing or pulling of the tool 100, the pins 465 will break. In one embodiment, breaking of the shear pins 465 may result in extending the length of the outer housing 460 until an internal stop is reached. This extension of the outer housing may be of several inches. As such, the drift ring 300 and the drift ring actuator 400 may shift away from one another. This may result in relieving stress at the abutment 440 and allowing the drift ring 300 to re-assume a naturally closed position, thereby reducing the diameter of the arms 101. Thus, the tool 100 of a now smaller profile may then be removed from the downhole stuck position.

As described above, the arms 101 are opened to a larger diameter without the need to remove the tool 100 in order to change the drift ring 300 to one of a larger size. Similarly, hydraulic pressure may be reduced to ultimately direct the j-slot mechanism 450 in an uphole direction. In this manner, the diameter of the drift ring 400 and arms 101 may be reduced. Again this is achieved without the need to remove the tool 100. Additionally, it is worth noting that employment of a j-slot mechanism 450 in this manner allows the change in positions to be achieved in a relatively stable manner with pins 455 moving from one secure location in a chamber 457 to another. In one embodiment, the adjacent chambers 457 are positioned relative to one another so as to attain between about 0.125 inch and about 0.75 inch increment changes in the diameter of the arms 101 from one chamber 457 to the next. For example, in one embodiment, the arms 101 are changed from a 2 inch diameter to a 2.5 inch diameter to a 3 inch diameter as the pins 455 move downhole from chamber 457 to chamber 457 to chamber 457.

Alternative positioning techniques may be employed. For example, the j-slot mechanism may have a variety of additional chambers 457, increasing the number of arm diameter sizes that may be achieved. Furthermore, while 30 different chambers 457 would seem to provide a sizing akin to conventional drift ring sizing options, in an even more practical embodiment, the j-slot mechanism 450 may itself be of an adjustable configuration. That is, the a j-slot mechanism 450 may be configured to achieve one range of arm diameter sizing during initial downhole use. Subsequently, the tool 100 may be removed from the well and the j-slot mechanism 450 adjusted to provide a different range of arm diameter sizing upon re-insertion into the well. Thus, a complete range of arm diameter sizing may be achieved without the need for upwards of 30 different conventional drift ring sizes.

In addition to alternative j-slot mechanism 450 configurations, arm diameter sizing may be directed through means aside from a j-slot mechanism 450. For example, a hydraulic mechanism or an electro-mechanical mechanism may be employed to more directly affect the positioning of the drift ring actuator 400 without the use of an intervening j-slot mechanism 450.

Figure 5A:
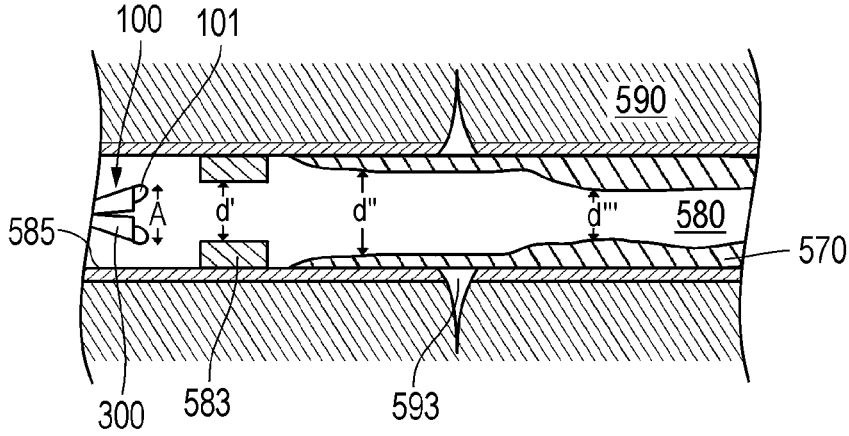
FIG. 5A is a side view of the scale removal tool of FIG. 1 positioned at a first location in a well with the fluid dispensing arm in a first position relative to a wall of the well.
Figure 5B:
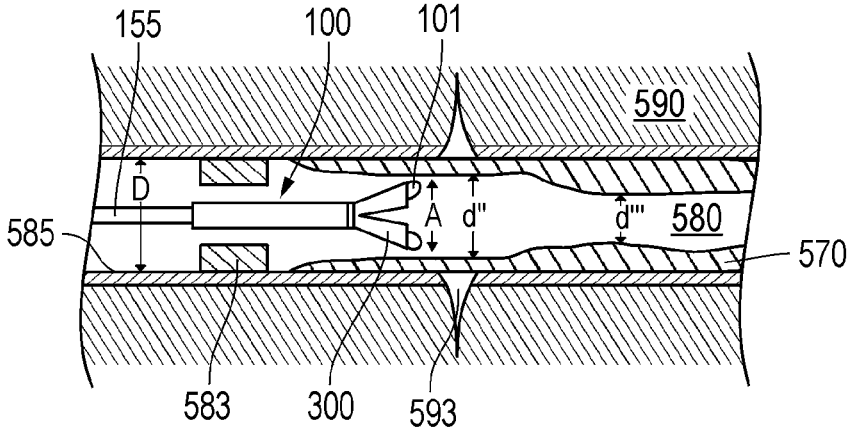
FIG. 5B is a side view of the scale removal tool of FIG. 1 positioned at a second location in the well of FIG. 5A with the fluid dispensing arm in a second position relative to the wall.
Figure 5C:
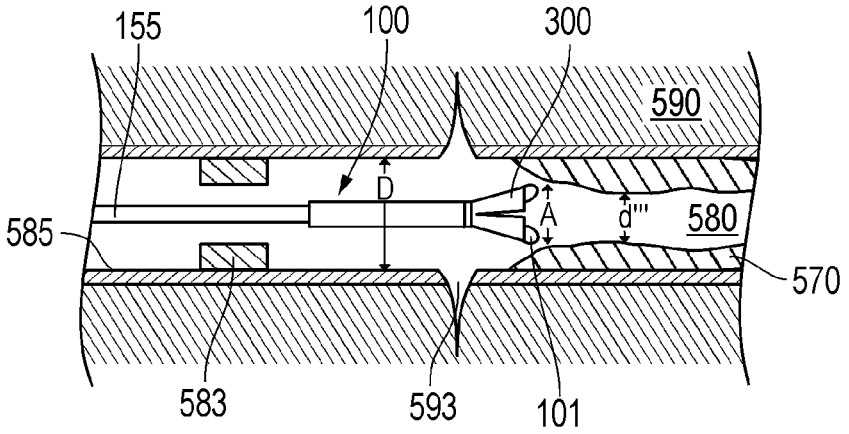
FIG. 5C is a side view of the scale removal tool of FIG. 1 positioned at a third location in the well of FIG. 5A with the fluid dispensing arm in a third position relative to the wall.

Referring now to FIGS. 5A-5C, an embodiment of advancing the scale removal tool 100 through a well 580 is described. The well 580 includes a restriction 583 as well as scale 570 of varying thicknesses built up on the walls of a borehole casing 585 through a formation 590. Thus, the effective diameter (d', d", d'") changes from location to location to location. As a result, the arm diameter A may be dynamically changed as necessary.

Continuing with reference to FIGS. 5A and 5B, a drift run may be run in advance of positioning the scale removal tool 100 in the well 580. In this manner, the location of well features such as the restriction 583 may be known. Additionally, a degree of scale information may be determined (e.g. as it relates to certain minimum effective diameters). This information may be stored at surface equipment 150 such as that of FIG. 1 and employed in the operation. With particular reference to FIG. 5A, the arms 101 of the tool 100 may be open to an arm diameter A that is less than the effective diameter d' at the location of the restriction. However, upon advancing to the position of FIG. 5B, the drift ring 300 may be actuated as detailed above to open the arms to a diameter A that is within about an inch of the effective diameter d" at the location of the well 580 where scale 170 is blocking a perforation 593.

In the above described advancing of the tool 100, the arms 101 may be positioned for traversing the narrowest effective diameter d' at the location of the restriction 583. The arms 101 may then repositioned to a larger arm diameter A as the tool 100 encounters the first scale 170. With added reference now to FIG. 5C, with the arms 101 dynamically positioned into an effective position relative to the casing 585 and scale 170, the tool 100 may be employed to remove scale 170. As shown, the proper scale removal may result in the entire wall diameter D of the well 580 becoming effective. Indeed, the perforations 593 are unclogged by the tool 100 during the application.

Continuing with reference to FIG. 5C, the scale removal application proceeds with the tool 100 advancing to a location where a thicker presence of scale 570 has lead to a reduction in the effective diameter d'" of the well 580. That is, the diameter available for fluid passage has reduced from an effective diameter d" depicted in FIG. 5B to an effective diameter d'" depicted in the most downhole visible portion of the well 580. Nevertheless, the tool 100 is configured as detailed above so as to allow the arm diameter A to be dynamically reduced such that each arm 101 may be positioned to within about a half-inch of the wall 585 (i.e. at the surface of the scale 570 depicted in FIG. 5C).

Figure 6:
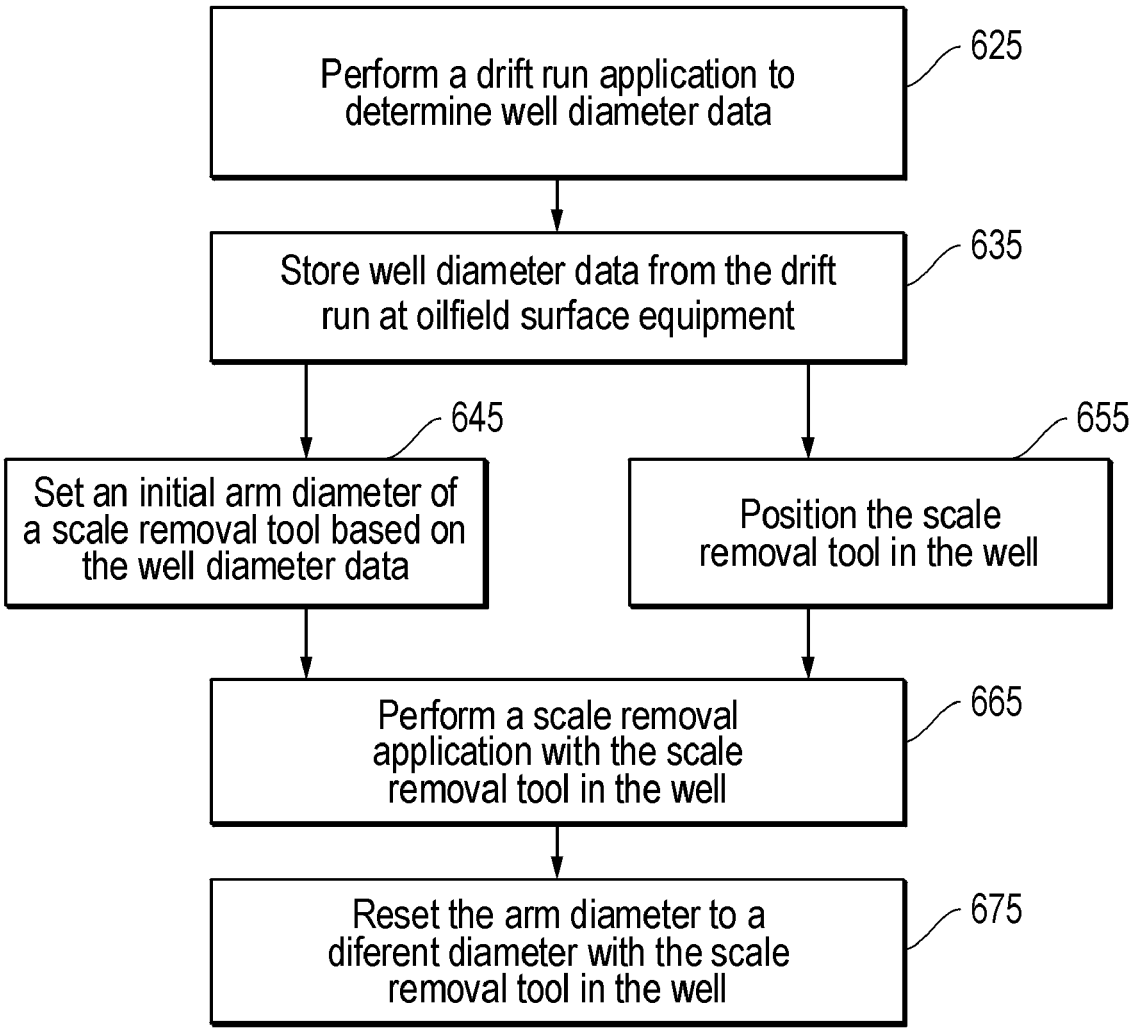
FIG. 6 is a flow-chart summarizing an embodiment of employing the scale removal tool of FIG. 1.

Referring now to FIG. 6, a flow-chart summarizing an embodiment of employing a scale removal tool as detailed above is described. That is, with some information available from a drift run as indicated at 625 and 635, coiled tubing may be employed to position a scale removal tool in a hydrocarbon well as indicated at 655. This positioning may take place before or after an initial arm diameter of the tool is set based in part on data obtained during the drift run (see 645).

Once the scale removal tool is positioned in the well with the arm diameter properly set, a scale removal application may be run in order to remove scale from a wall of the well as indicated at 665. However, as the profile of the well changes, the arm diameter may be reset to different diameters while the tool remains in the well as indicated at 675. In this manner, the arms of the tool may be positioned relative to scale at the well wall for optimum scale removal without the need to remove the entire tool from the well. Thus, substantial time and expense may be saved in performing the scale removal application.

Embodiments described hereinabove include a scale removal tool which may employ water jetting for removal of scale from a hydrocarbon well. While the dispensing arms may be securely pre-positioned for optimum scale removal at one location within the well, the arms may also be repositioned to another diameter in response to variable scale thickness within the well. Thus, scale removal need not take place with over the course of a host of multiple scale removal runs through the well. Rather, the repositioning of the arms allows for the operator to avoid removal of the tool from the well to achieve each new arm diameter setting. The resulting cost savings is enhanced further, depending on the depth of the well involved.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. Furthermore, the foregoing description should not be read as pertaining only to the precise structures described and shown in the accompanying drawings, but rather should be read as consistent with and as support for the following claims, which are to have their fullest and fairest scope.

We claim:

1. A tool for removal of scale from a well wall of a well, the tool comprising:

a first fluid dispensing arm;

a second fluid dispensing arm adjacent said first fluid dispensing arm with an adjustable arm diameter there-between for dynamic positioning of said arms relative to the well wall;

a drift ring of adjustable diameter about a portion of each of said arms to direct the dynamic positioning;

a mechanism coupled to said drift ring for actuation thereof;

a housing adjacent said mechanism and coupled to said drift ring; and a shear pin through said housing, said shear pin configured to extend said housing for reducing the adjustable diameter upon encountering a predetermined amount of force.

2. The tool of claim 1 wherein the well is of an effective diameter for fluid passage at a location in the well that is substantially less than a wall diameter of the well wall, the adjustable arm diameter less than the effective diameter.

3. The tool of claim 1 wherein said mechanism is one of a j-slot mechanism, a hydraulic mechanism, and an electro-mechanical mechanism.

4. The tool of claim 3 wherein the j-slot mechanism is of an adjustable configuration.

5. A method of removing scale from a wall of a hydrocarbon well, the method comprising:

positioning a scale removal tool in the well;

performing a drift run to determine well diameter data;

setting a first position of an arm of the scale removal tool relative to the wall based on the determined well diameter data;

directing a scale removal fluid through the arm of the scale removal tool toward scale on the wall; and resetting a second position of the arm relative to the wall with the scale removal tool downhole in the well.

6. The method of claim 5 wherein said directing comprises emitting the scale removal fluid from the arm at between about 1,000 PSI and about 2,000 PSI.

7. The method of claim 5 wherein said positioning is at a first location in the well with scale thereat, the method further comprising:

repositioning the scale removal tool to a second location in the well; and directing a scale removal fluid through the arm toward scale on the wall at the second location.

8. The method of claim 7 wherein said resetting is a first resetting achieved through a first j-slot mechanism sizing, the method further comprising:

removing the scale removal tool from the well; and adjusting the first j-slot mechanism sizing to a second j-slot mechanism sizing prior to said repositioning.

9. The method of claim 5 wherein said resetting comprises adjusting a diameter of a drift ring adjacent the arm.

10. The method of claim 9 wherein said adjusting is achieved through one of a j-slot mechanism, a hydraulic mechanism, and an electro-mechanical mechanism.

* * * * *